US005172898A

United States Patent [19]

Takahashi

[11] Patent Number: 5,172,898

[45] Date of Patent: Dec. 22, 1992

[54] PAPERBOARD FEEDING APPARATUS

[75] Inventor: Takehiro Takahashi, Hiroshima, Japan

[73] Assignee: Mitsubishi Jukogyo Kabushiki Kaisha, Tokyo, Japan

[21] Appl. No.: 724,867

[22] Filed: Jul. 2, 1991

[30] Foreign Application Priority Data

Jul. 5, 1990 [JP] Japan ..... 2-71695[U]
Jul. 5, 1990 [JP] Japan ..... 2-71696[U]
Aug. 24, 1990 [JP] Japan ..... 2-223889

[51] Int. Cl.[5] ..... B65H 5/00

[52] U.S. Cl. ..... 271/10; 271/243; 271/270; 414/797.7

[58] Field of Search ..... 271/10, 11, 109, 114, 271/116, 117, 118, 112, 243, 270, 112; 414/797.7

[56] References Cited

U.S. PATENT DOCUMENTS 4,508,210 4/1985 Ramcke et al. ..... 198/626.5
4,614,335 9/1986 Sardella ..... 271/112
4,838,408 6/1989 Brawn ..... 198/461
4,889,331 12/1989 Sardella ..... 271/118
5,006,042 4/1991 Park ..... 271/114
5,039,086 8/1991 Matsuno et al. ..... 271/243
5,050,852 9/1991 Sawada et al. ..... 271/114

*Primary Examiner*—H. Grant Skaggs
*Attorney, Agent, or Firm*—McGlew and Tuttle

[57] ABSTRACT

The present invention relates to a lead edge type paperboard feeding apparatus suitable for a box making machine for corrugated board sheets and the like, and more particularly, provides a paperboard feeding apparatus provided with delivery rolls which deliver paperboards piled up between a front guide and a backstop are delivered successively from the lowest layer, comprising a mechanism which, when the dimension of above-mentioned paperboard reaches a predetermined length and longer, above-mentioned backstop is amde to vary (ascend and descend or incline) automatically interlocking with the variation in length (or interlocking step-wise at a predetermined ratio), or an indexing unit which is able to set a start timing or a stop timing of feeding selectively.

8 Claims, 14 Drawing Sheets

O1 : PERIPHERAL SPEED OF FEED ROLL = PERIPHERAL SPEED OF DELIVERY ROLL

PAPERBOARD FEEDING APPARATUS

FIELD OF THE INVENTION

The present invention relates to a lead edge type paperboard feeding apparatus applied to a box making machine for corrugated board sheets and the like.

BACKGROUND OF THE INVENTION

FIG. 8 is an explanatory view for explaining operation of a conventional paperboard feeding apparatus of lead edge type; FIG. 9 and FIG. 10 are explanatory views for explaining nonconformity of the conventional feeding apparatus. In general, a feeding section of a box making machine for corrugated board sheets is an unit in which corrugated board sheets 1 piled up on a feeding table 16 are delivered successively one sheet at a time from the lowest layer through delivery rolls 4.

In the figure, a backstop 3 is constructed so as to be able to move longitudinally (between 3 and 3') on the feeding table 16 and to be fixed at any position corresponding to a length in feeding direction of the corrugated board sheets 1. The corrugated board sheets 1, which are charged from a preprocess not shown, drop when they abut against a front guide 2, and are piled up successively between the backstop 3 and the front guide 2. Further, a plurality of delivery rolls 4 are provided under the lowest layer sheet 1*a* in a state of projecting slightly above the feeding table 16. Besides, the inside of a suction box 6 is connected with a vacuum pump or a suction blower 8 through a duct 7.

In above-described construction, the suction box 6 is brought into an almost sealed state by covering the upper surface of the suction box 6 with the lowest layer sheet 1*a* so as to form a negative pressure region inside by operating above-mentioned suction blower 8, thereby to function so as to increase a frictional force Fo between the lowest layer sheet 1*a* and the delivery rolls 4. On the other hand, a frictional force F caused by the weight (direct pressure) of sheets which are piled up above a sheet 1*b* at the second step is generated on the top surface of the lowest layer sheet 1*a*, and the lowest layer sheet 1*a* is delivered by the difference between frictional forces generated on the top surface and the under surface of the sheet (delivery force applied to the sheet $f=Fo-F$), and is delivered further to a downstream process (printing section) by means of rotation so as to be put between field rolls 5*a* and 5*b* provided downstream.

In a conventional feeding apparatus described above, a gap at a lower end of the front guide 2 is set so as to be a little wider than the thickness of the paperboard 1 by means of a gap adjusting means not shown. Since the height of the tip of the paperboard 1 from the top surface of the feeding table 16 varies depending on the degree of a deformed state of the paperboard 1 such as a warping state (upward warping, downward warping) and a curved state, it has been required to readjust the gap every time such deformation occurs. Further, in case the above-mentioned gap is inappropriate, e.g., when the gap is small with respect to the upward warping deformation quantity as shown in FIG. 4 for instance, the tip of the sheet 1*a* collides with the lower end portion of the front guide 2. Furthermore, in a deformed state as described above, the negative pressure in the suction box 6 is not increased by the fact that outside air inflows from the gap at the tip of the sheet 1*a*, The frictional force Fo between the lowest layer sheet 1*a* and the outer peripheral surfaces of the delivery rolls 4 becomes smaller, and the sheet delivery force f is decreased. There has been a problem that such a tendency becomes more conspicuous as the sheet dimension gets longer since it almost corresponds to the warping deformation quantity of the sheet.

Further, when the gap at the lower end portion of the front guide 2 is set wide against sheet deformation (upward warping) in view of above-mentioned nonconformity, a phenomenon of feeding two sheets is generated in such a manner that the sheet 1*b* at the second step which is to be delivered in the next place is delivered simultaneously with the lowest layer sheet 1*a* to be delivered when non-deformed sheets are piled up as shown in FIG. 5.

As described above, in a conventional feeding apparatus, these unstable factors remain and drift in feeding timing (unevenness of drift quantity) occur easily, and have caused the deterioration of quality such as variation of printing positions in a following process. Furthermore, there has been a problem that, when a sheet delivery trouble such as a feeding mistake (two sheets feeding for instance) is generated, the machine has to be stopped to cope with the trouble, thus decreasing productivity remarkably.

Thus, a conventional feeding apparatus has not been provided with a function that deformed (warped upwardly or warped downwardly) paperboard can be delivered surely by having the paperboards engage with a delivery means. As a result, in such a method those deformed sheets are piled up on a table after correcting the warping deformation manually to some extent, or a feeding speed is reduced has been adopted. In such a method, however, correction not only takes time, but also complete correction is impossible. In a paperboard having a long dimension in particular, unevenness of warping deformation quantity is large, and variety of defective sheets of paper board are produced easily by a feeding mistake (such as two sheets feeding, no delivery and unevenness of feed timing). Further, the machine had to be stopped sometimes for repair of the worst trouble, and serious unstable factors such as deterioration of quality and productivity remained.

FIG. 11 and FIG. 12 are explanatory views for explaining construction and function (operation timing) of conventional feeding apparatus which have been proposed in specifications of U.S. Pat. No. 4614335, No. 4681311 and No. 4828244. As shown in FIG. 11, a feeding apparatus of this type is constructed in such a manner that corrugated board sheets 103 piled up on a feeding table 102 are made to pass through a gap formed at a lower end portion of a front guide 104 by the rotation of delivery rolls 105 so as to deliver one sheet at a time downstream successively from the lowest layer sheet 103*a*. Further, a suction box 106 connected with a suction blower 108 through a duct 107 is provided at a position under a part of the corrugated board sheets 103. The suction box 106 is brought into an almost sealed state by covering an upper adsorbing surface with above-mentioned lowest layer sheet 103*a*, and a negative pressure region is formed inside by the action of the suction blower 108, thereby to function so as to increase a frictional force Fo between the lowest layer sheet 103*a*and the delivery rolls 105 which are delivery means.

Further, in a delivery roll 105 section, a receiver board 110 which is disposed at a gap portion of the disposed delivery rolls 105 and in which a relative height from an outer peripheral surface of the rolls 105 is variable is provided. This receiver board 110 has the lowest layer sheet 103*a* which comes in contact with the delivery rolls 105 by vertical ascent and descent attached and released, and functions to descend the sheet 103*a* below a sheet pass-line so that the outer peripheral surfaces of the delivery rolls 105 and the under surface of the sheet come in contact with each other thereby to apply a rotating delivery force and ascends the sheet 103*a* conversely thereby to cut off the delivery function of the delivery rolls 105.

Now, above-mentioned corrugated board sheet 103 is delivered between downstream feed rolls 109*a* and 109*b* by means of the operation of a delivery force $f=Fo-F$ generated onto the sheet at a frictional force Fo between the lowest layer sheet 103*a* and the delivery rolls 105 and a frictional force F between the lowest layer sheet 103*a* and the sheet 103*b* at the second step, and is delivered further to a following printing process by the rotation so as to be put between the feed rolls 109*a* and 109*b*.

FIG. 12 shows the operation of the delivery roll 105 and the receiver board 110 along the axis of ordinate against a machine feeding period (axis of abscissa). The corrugated board sheet 103*a* comes in contact with the delivery roll 105 by the descent of the receiver board 110, and is transferred by the accelerated rotation (peripheral speed) of the delivery roll 105. When transfer of the corrugated board sheets 103 is taken over at a point $O_1$ where the accelerated rotation coincides with the peripheral speed of the downstream feed rolls 109*a* and 109*b*, the transfer function is released by the ascent of the receiver board 110 at almost the same timing. Besides, the delivery roll 105 continues to rotate and stops at a point $O_2$ after making one rotation. In the delivery of the next sheet 103*b* after one cycle is completed, the delivery roll 105 is rotated again after descending the receiver board 110, thereby to deliver the sheet 103*b* downstream as described previously. By repeating the same operation successively thereafter, it is set so that piled up corrugated board sheets 103 are delivered successively from the lowest layer sheet.

A conventional feeding apparatus described above is constructed and functions as described above, however, there has been such a problem as follows. That is, it is constructed so that an ascent timing of the receiver board 110 which keeps contact with the delivery rolls 105 for sheet delivery is always fixed (no correcting function) against a descent timing. Therefore, when the dimension of the corrugated board sheet 103 gets longer, the increased frictional force (sliding resistance) F between the lowest layer sheet 103*a* and the sheet 103*b* at the second step is entirely borne by rotation with supporting between downstream feed rolls 109*a* and 109*b*, which produces a main cause for delay of feed timing. Further, there has been such a problem that the relative timing of the start timing (rotation start timing) of the delivery rolls 105 cannot be altered, but feeding slippage (unevenness of slippage quantity) varies whenever load conditions such as machine speed, weight of piled up sheets (length, number of piled up sheets) and sheet material (coefficient of friction) are varied, thus causing troubles in post-processes in addition to printing.

Accordingly, it has been required to provide a mark positioning means (unit) in each unit in order to correct slippage of feed timing in a following process. Further, above-mentioned problem has not only increased defective paper generating quantity, but also caused to lower productivity remarkably coupled with frequent order changes.

In a conventional paperboard feeding apparatus constructed as described above, the ascent timing of the receiver board which separates contact between a sheet and delivery rolls which are delivery means of the sheet cannot be altered, but a rear lower surface of the lowest layer sheet slides while in contact with the receiver board when the sheet dimension gets longer. Thus, the delivery resistance is increased, and delay in feed timing has been caused. Further, feeding slippage quantity (drastic unevenness of feed timing) varies every time load conditions such as machine speed, sheet weight (height and length of piled up sheets) and sheet material are varied, thus it has been required to perform mark setting for all the printing colors each time in a following process such as a printing section.

When another conventional feeding apparatus is described with reference to FIG. 13 to FIG. 15, FIG. 13 to FIG. 15 are explanatory views for explaining a construction of a conventional feeding apparatus of lead edge type and nonconformity in the apparatus, and FIG. 12 is an explanatory diagram for explaining an operation timing of the lead edge feeder. The structure of a conventional feeding apparatus will be described briefly hereafter. As shown in FIG. 13, a feeding apparatus of the present type is constructed so that corrugated board sheets 203 piled up on a feeding table 224 are delivered downstream one sheet at a time successively from a lowest layer sheet 203*a* through a gap formed at an lower end portion of a front guide 201 by the rotation of delivery rolls 204 provided under a sheet pass-line. A duct 225 is arranged under the corrugated board sheets 203 of this apparatus, and a suction box 206 connected with a suction blower 226 through the duct 225 is provided at a location under a part of the corrugated board sheets 203. The suction box 206 is brought into an almost sealed state by covering an upper adsorbing surface with above-mentioned lowest layer sheet 203*a*, thus forming a negative pressure region inside by the operation of a suction blower 226, and functions so as to increase a frictional force Fo between the lowest layer sheet 203*a* and delivery rolls 204 which are delivery means.

A receiver board 205 in which a relative height position with respect to the outer peripheral surfaces of rolls 204 is variable is provided at a delivery roll 204 section through holes formed at locations corresponding to the rolls 204. This receiver board 205 is constructed so that it may be ascended and descended, and detaches the under surface of the lowest layer sheet 203*a* which comes in contact with the delivery rolls 204 by ascent and descent of the receiver board 205. The receiver board 205 applies a rotational delivery force of the delivery rolls 204 by having the receiver board 205 descend from the sheet pass-line with respect to the sheet 203*a*, and has the receiver versely so as to cut off delivery function of the sheet 203*a* by the delivery rolls 204. Now, with above-mentioned structure, the corrugated board sheet 203 is subject to an interaction of a frictional force $f=Fo-F$ generated on the sheet by the difference between a frictional force Fo generated between the lowest layer sheet 203*a* and the delivery rolls 204 and a frictional force F generated between the lowest layer sheet 203*a* and the sheet 203*b* at the second step. The sheet 203*a* is delivered by this force inbetween downstream feed rolls 207*a* and 207*b*, and delivered further to a following printing process P by rotation while being supported by the feed rolls 207*a* and 207*b*.

Next, an operation (function) of above-mentioned conventional feeding apparatus will be described. FIG. 12 shows the operation of the delivery rolls 204 and the receiver board 205 taken along an axis of ordinate against paperboard feeding period (axis of abscissa). As shown in the figure, the corrugated board sheet 203*a* comes in contact with the delivery rolls 204 by the descent of the receiver board 205 and is transferred by accelerated rotation (peripheral speed), and the transfer thereof is taken over at a point $O_1$ where the rotation coincides with the peripheral speed Vo of the downstream feed rolls 207*a* and 207*b*. The delivery rolls 204 lose transfer function by the ascent of the receiver board 205 simultaneously with the taking over, and the delivery rolls 204 continue to rotate thereafter and stop at a point $O_2$ after one rotation. When a next sheet 203*b* is delivered after completion of one cycle, the delivery rolls 204 are rotated again after descending the receiver board 205 so as to deliver the sheet 203*b* downstream. It is set so that piled up corrugated board sheets 203 are delivered successively from the lowest layer sheet side by repeating above-mentioned operation successively thereafter.

The illustrated conventional feeding apparatus is constructed and functions as described above, and has such problems as follows.

That is to say, because of a structure that the ascent timing of the receiver board 205 which interrupts the contact between the delivery rolls 204 and the sheet 203 for the purpose of sheet delivery is always constant (no correcting function) with respect to the descent timing, the increased frictional force (sliding resistance) F between the lowest layer sheet 203*a* and the sheet 203*b* at the second step has to be borne entirely by the rotation while being held by downstream feed rolls 207*a* and 207*b* as the dimension of the corrugated board sheet 203 gets longer, thus causing such a serious problem that the feed timing is delayed.

Further, as shown in FIG. 15, feeding slippage (unevenness of slippage quantity) is generated every time load conditions such as machine speed, weight of piled up sheets (length, number of piled up sheets) and sheet material (coefficient of friction) are varied, thus resulting in troubles frequently in a post-process such as printing. FIG. 14 shows variation of a distance x from a front end of a sheet to the printing start position O on above-mentioned load conditions. There is a tendency that the bigger the load becomes ($A_0 \rightarrow A_2$) against reference setting load condition $A_0$, the shorter above-mentioned $x_1$ becomes, and, in contrast with this, the smaller the load reduces ($A_0 - A_1$), the longer the distance $x_2$ becomes. Such a tendency is generated by the fact that frictional forces F and Fo on the top surface and the under surface of the lowest layer sheet 203*a* are varied by load variation, and the slippage quantity between the delivery rolls 204 and the lowest layer sheet 203*a* is varied. With this, relative positional relationship between the corrugated board sheet 203 and a printing plate 222 on a plate cylinder 221 in a printing section P varies, thus causing that a printing position slips fore and aft in the flow direction of the sheet 203. Besides, FIG. 15 shows above-mentioned tendency in the concrete, and shows a case $x_1$ in which the feed timing is delayed with respect to a distance $x_0$ to an ideal printing start position and a case $x_2$ in which the feed timing is too early, respectively.

It has been heretofore required to provide a mark positioning means (unit) in each unit for the purpose of correcting slippage of the feed timing in a downstream printing process in order to eliminate such nonconformity. However, since feed slippage quantity as described above is not fixed, but is different for each sheet in many cases, only the correction in the printing process has not been satisfactory. Furthermore, above-described problems have caused not only to increase defective paper board generating quantity, but also to lower productivity remarkably coupled with frequent order changes.

As described with respect to above-mentioned related art, there has been such a serious problem in a paperboard feeding apparatus which has been available so far that unevenness of the sheet delivery timing caused by slippage quantity variation between a sheet and delivery rolls which are delivery means of the sheet is large, thereby to deteriorate the product quality (accuracy). In other words, feeding slippage (large unevenness in feed timing) is generated every time the load conditions such as machine speed, sheet weight (piled up height and length of the sheets) and sheet material are varied, and it has been required to perform mark positioning each time in a following process such as a printing section.

OBJECT AND SUMMARY OF THE INVENTION

It is an object of the present invention which has been made in view of such circumstances to provide a paperboard feeding apparatus in which above-mentioned problems have been solved.

The gist of the present invention in order to achieve above-mentioned objects is as stated in the following items (1), (2) and (3).

(1) A paperboard feeding apparatus provided with delivery rolls which deliver paperboards piled up between a front guide and a backstop are delivered successively from the lowest layer, comprising a mechanism which, when the dimension of above-mentioned paperboard reaches a predetermined length and longer, above-mentioned backstop is made to vary (ascend and descend or incline) automatically interlocking with the variation in length or interlocking step-wise at a predetermined ratio.

As to the operation thereof, it is possible to have a front end portion of a corrugated board sheet approach to and engage with the upper surface of a suction box by having a rear end side of the corrugated board sheet ascend corresponding to the sheet length. It is thus possible to adsorb the under surface at the front end portion of deformed (warped upwardly) or curved corrugated board sheet along an upper sheet suction surface of the suction box stably, and also possible to increase a frictional force between delivery rolls and an under surface of the lowest layer sheet. Accordingly, sheet delivery can be made surely cojointly with transfer effects of an intermediate conveyor belt and rolls, and that working accuracy in a downstream process such as printing is increased since feed timing becomes accurate.

Since the present invention is constructed as described above, and a mechanism of raising a rear end portion of a sheet corresponding to the length of a corrugated board sheet is provided, it is easy to have the under surface at the front portion of a paperboard adhere closely to the upper surface of the suction box even for a deformed sheet (particularly upward warping), thus stabilizing (making sure) the suction force. Further, since it is possible to have the under surface of the sheet come into contact with the delivery rolls stably, the delivery force is increased, thus making it possible to reduce unevenness of feed timing. As a result, it is possible to increase a machine operation rate and also to aim at improvement of quality (working accuracy) in a following process such as printing.

(2) A paperboard feeding apparatus composed of delivery rolls which deliver paperboards piled up between a front guide and a backstop from a lowest layer successively and a receiver board which releases engagement (contact) between the lowest layer sheet and the outer peripheral surfaces of the delivery rolls by ascent and descent, comprising an indexing device constructed so that the rotation start timing of delivery rolls may be set freely and selectively in order to determine the start timing of feeding.

As to the operation thereof, the receiver board is made to ascend after delivery at a predetermined angle, the contact between the delivery rolls and the lowest layer sheet is released, and the delivery rolls are stopped with speed reduction, thus keeping them waiting in that state. On the other hand, the receiver board descends after the delivery rolls stop to rotate, and stops in a state that a following sheet is made to come in contact with peripheral surfaces of the delivery rolls. Further, it is possible to set the start timing of feeding freely fore and aft and selectively by means of the indexing unit and to correct print slippage in a downstream process. Further, since it is possible to set the acting time of the delivery rolls corresponding to the sheet length, variation of a frictional force applied to the lowest layer sheet is reduced and slippage of feed timing disappears.

As described above, according to the present invention, it is possible to set the start (initial rotation) timing of the delivery rolls which are delivery means of paperboards optionally by means of an indexing unit, and to correct slippage of printing positions in a downstream process. Further, the acting time of the delivery rolls corresponding to the sheet length can be set by phase adjustment of a cam for receiver board action (ascent and descent). Therefore, variation of the frictional force applied to the lowest layer sheet is reduced, and slippage of feed timing disappears. Furthermore, since load conditions such as machine speed, paperboard weight, paperboard material and sheet length are inputted, and above-described setting can be made through a control unit, feed timing can be controlled automatically. Further, correction (various setting) of feed timing in keeping with order changes can be made simply and accurately, thus making it possible to aim at improvement of productivity and quality.

(3) A paperboard feeding apparatus provided with delivery rolls which deliver paperboards piled up between a front guide and a backstop successively from the lowest layer, characterized in that an endless belt with a claw for abutting against the paperboard fixedly attached on an outer surface thereof is disposed, such a feed timing remedy means that above-mentioned claw portion located always on a straight line with respect to paperboard travelling direction drives the endless belt for feeding is provided, and furthermore, a control unit which computes and controls the driving speed of above-mentioned timing remedy means based on the feeding speed of above-mentioned feeding apparatus is provided, on the downstream of the feeding apparatus.

As to the operation thereof, the tips of paperboards delivered in an uneven state fore and aft in the travelling direction by variation of load conditions such as machine speed, weight of piled up sheets, sheet material and sheet length are damped once by a claw fixedly attached to the endless belt, and the paperboards can be delivered by releasing the claw at a predetermined timing corresponding to a following process (printing). Since it is possible to deliver downstream in a state that slippage (unevenness) of the delivery timing from a feeding section is remedied accurately with the above, it has become possible to improve working accuracy such as printing position remarkably.

As described above, according to the present invention, it is possible to deliver to a following process after correcting unevenness of feed timing which has been a problem of a conventional feeding apparatus by means of a remedy unit installed downstream. As a result, it is possible to aim at improvement of quality such as appearance and accuracy in working such as printing. Further, various activities for coping with troubles such as defective printing are no longer required and machine operation rate is increased, thus making it possible to aim at improvement of productivity. Furthermore, according to the present invention, it is possible to correspond to paperboards having great variety of specifications, and such effects that production (product) range is expanded may be expected.

DETAILED DESCRIPTION OF PREFERRED EMBODIMENTS

Embodiments of the present invention will be described hereafter with reference to the drawings.

The First Embodiment

Figure 1:
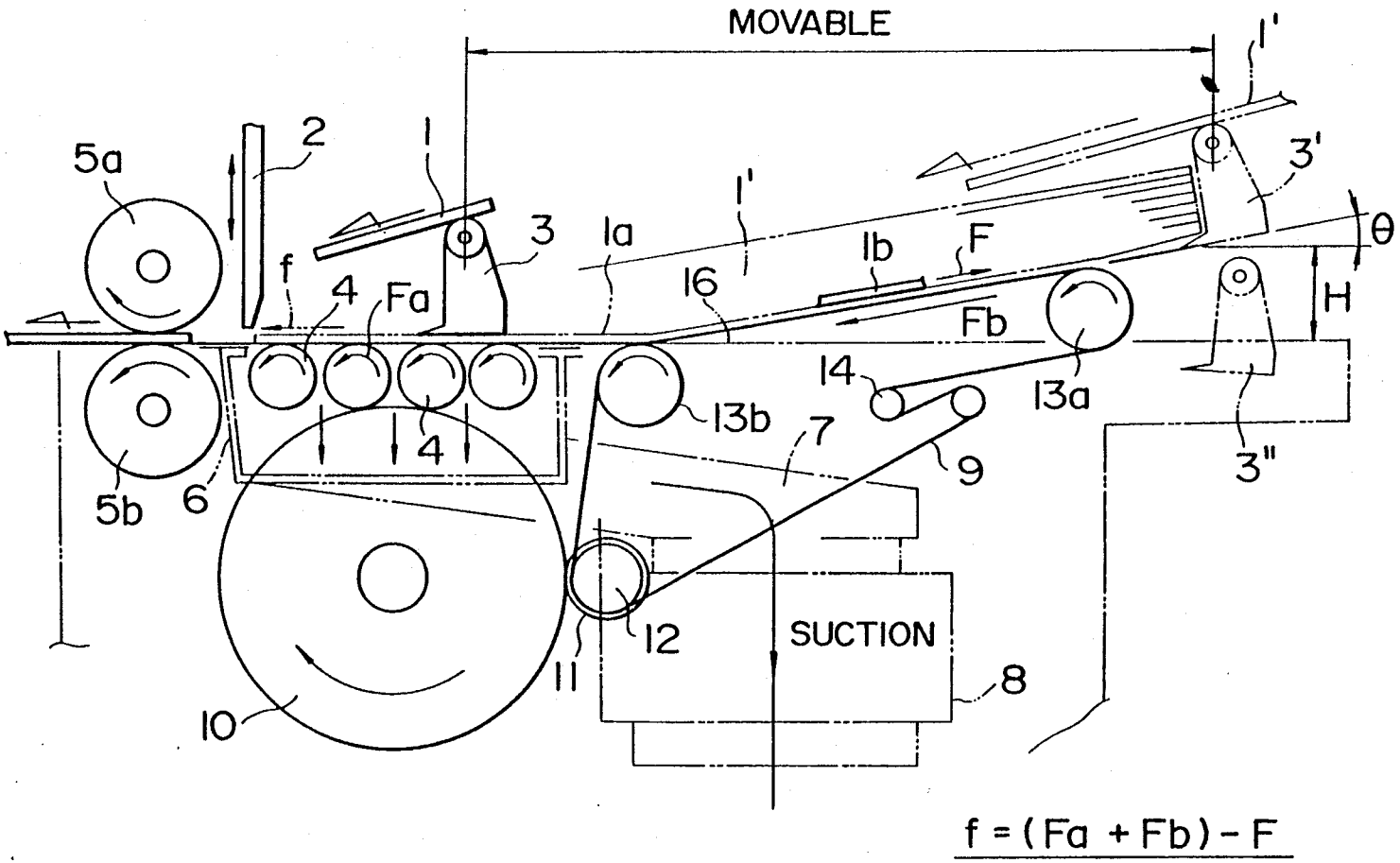
FIG. 1 is a side view for explaining a structure of a paperboard feeding apparatus showing a first embodiment of the present invention.
Figure 2A:
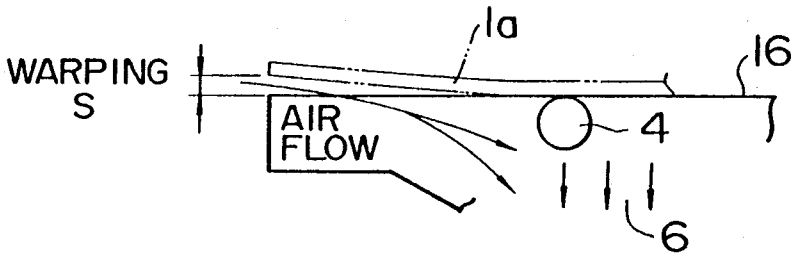
FIG. 2*a* shows an example of a deformed (warped upwardly) corrugated board sheet.

FIG. 1 and FIGS. 2*a* and *b* show a first embodiment of the present invention. FIG. 1 is an explanatory view of a schematic construction of a paperboard feeding apparatus, and FIGS. 2*a* and *b* are an explanatory view for explaining the function of the apparatus, in which dashed lines show a conventional sheet state.

Now, the paperboard feeding apparatus shown in FIG. 1 is a lead edge feeder which is constructed in such a manner that paperboards 1 are charged and piled up between a front guide 2 which is constructed to ascend and descend corresponding to the thickness of a paperboard 1 and in which a gap quantity at a lower end portion thereof may be set variably and a backstop 3 that is able to be set by moving fore and aft corresponding to the length of piled up paperboards 1, and the paperboard 1 is delivered inbetween downstream feed rolls 5*a* and 5*b* from the lowest layer 1*a* successively by a frictional force Fo of peripheral surfaces of delivery rolls 4 and the rotation thereof. This apparatus has such a structure that the height H and the inclination $\theta$ of above-mentioned backstop 3 vary automatically interlocking with variation in length when the paperboard dimension reaches a predetermined length and longer. A combination mechanism of a cam, a link, an air pressure mechanism and the like is possible as a variable mechanism for the height and the inclination of the backstop 3, which, however, is not limited thereto. Besides, numeral 6 in FIG. 1 denotes a suction box, and a negative pressure region is formed inside the box 6 by a suction force of a suction blower 8 connected through a duct 7. Thus, the suction box 6 functions so as to have the under surface at the front end portion of the lowest layer sheet 1*a* come into contact with the peripheral surfaces of the delivery rolls 4 with a predetermined pressure. Besides, the function of the suction box 6 is similar to that of a well-known type which has been described in above-mentioned conventional exemplification.

Further, 9 denotes an endless belt (intermediate conveyor) which winds around a gear 11 engaged with a gear 10 of a conventional apparatus, a pulley 12 fixedly attached to the gear 11, guide pulleys 13*a* and 13*b* and a tension pulley 14 and travels synchronously with a peripheral speed of the delivery rolls 4. This endless belt 9 may be substituted by disposing rolls 15 which rotate synchronously with the peripheral speed of the delivery rolls 4, and functions so as to increase a delivery force f of the sheet by coming into contact with the lowest surface at the rear end portion of a long corrugated board sheet and driving it to rotate.

Next, the operation of the present feeding apparatus will be described with reference to FIGS. 2(*a*) and 2(*b*). A corrugated board sheet 1*a* at the lowest layer which has been deformed (warped upwardly) in a conventional feeding apparatus is piled up on a feeding table 16 in such a state as shown with a dashed line in the figure. Accordingly, a gap having an approximately v shape formed by warping of the corrugated board sheet 1*a* is produced on the top surface of the suction box 6, and outside air inflows therein freely. It is impossible to increase the sheet suction force by negative pressure because of the air inflow (or it takes time for adsorption). Thus, the frictional force Fo of the delivery rolls 4 becomes small, and a delivery force f applied to the sheet becomes weak. Further, a tip hits against the lower end of the front guide 2, thus making downstream delivery impossible for the sheet 1 having large deformation quantity as shown in FIG. 2 (*b*).

Figure 2B:
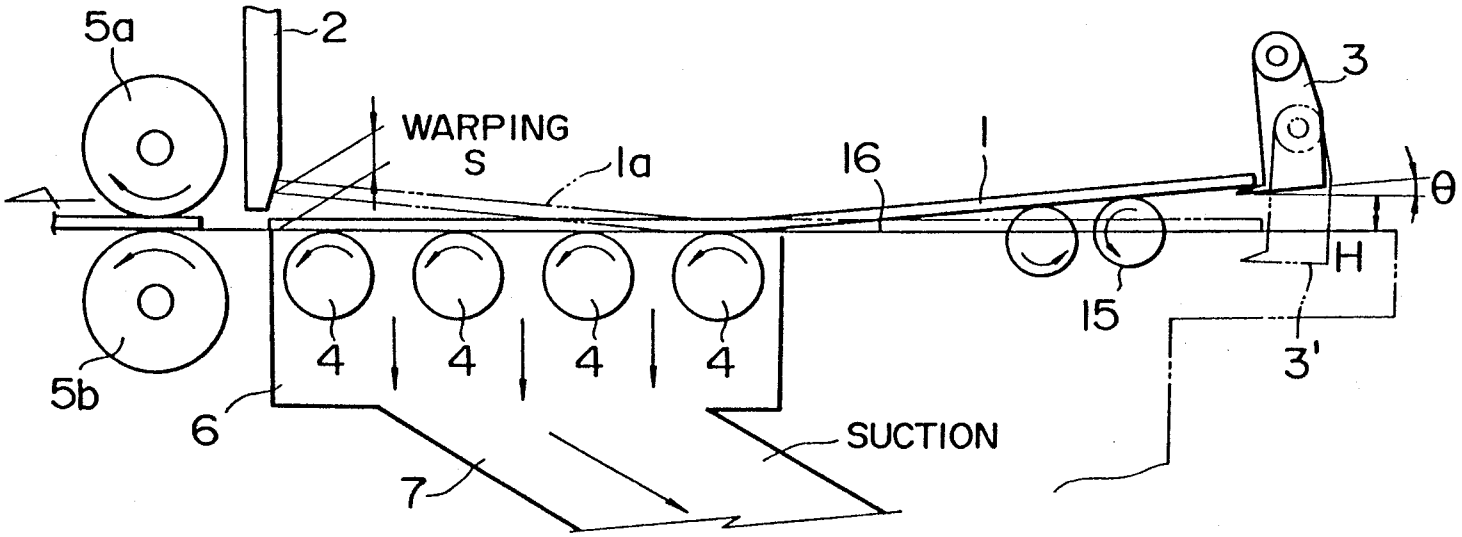
FIG. 2*b* shows an example of a largely deformed corrugated board sheet.

The present embodiment is characterized in that, by having the rear end side of the corrugated board sheet 1 ascend corresponding to the sheet length as shown with a solid line in FIG. 2 (*b*), and front end portion of the sheet is made to approach and to be adsorbed to the top surface of the suction box 6 in view of above-mentioned conventional nonconformity. With this, it is possible to increase the frictional force Fo between the lowest layer sheet 1*a* and the peripheral surfaces of the delivery rolls 4. Thus, the sheet delivery force f is stabilized (increased), thereby not only to make feeding secure, but also to increase the accuracy of feed timing. Further, repair work on sheet deformation which has been performed manually becomes no longer required by means of above-mentioned function.

The Second Embodiment

Figure 3:
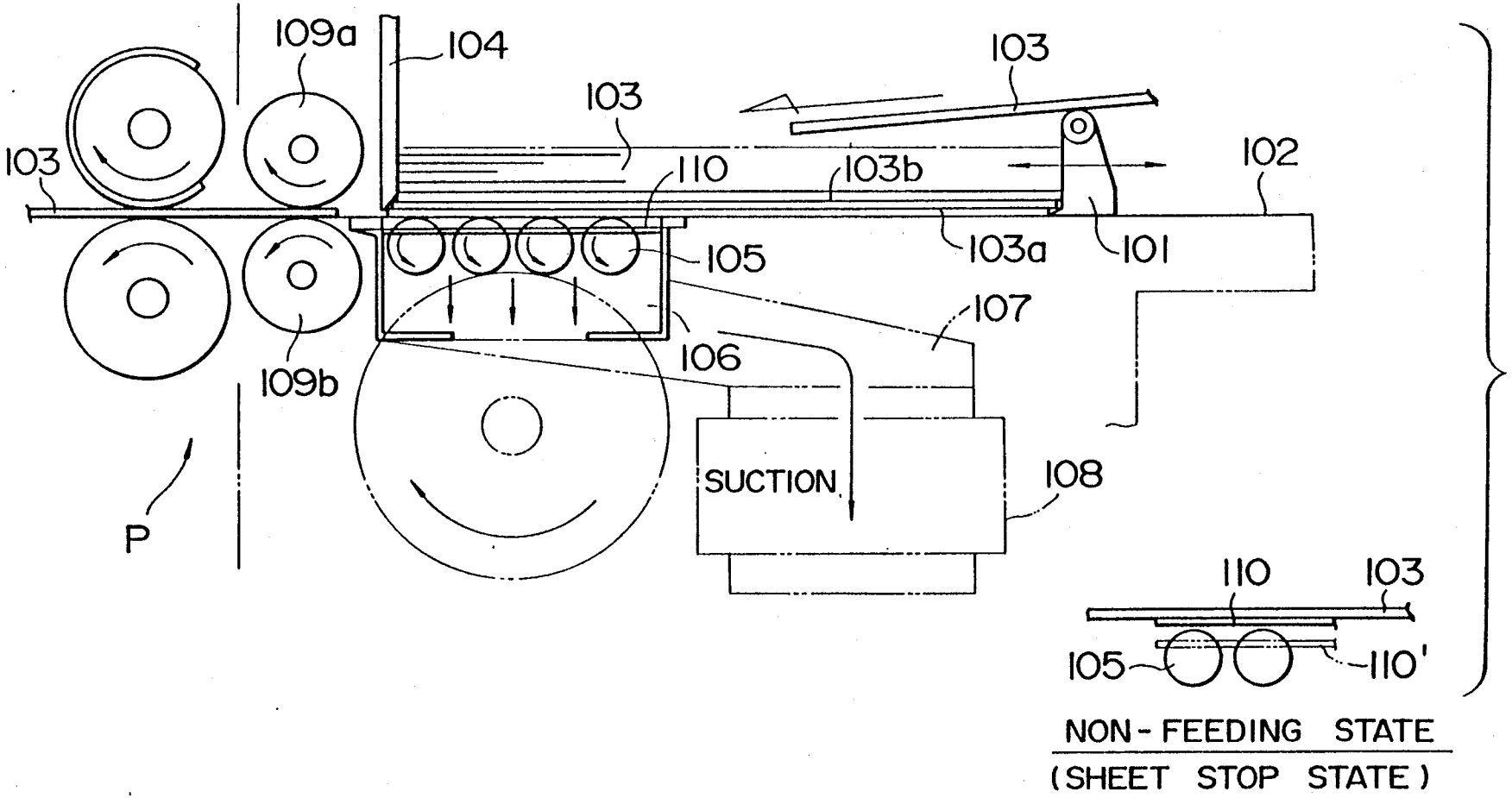
FIG. 3 is a side view of a lead edge type feeding apparatus provided with a feeding slippage correction unit on a paperboard feeding apparatus showing a second embodiment of the present invention.
Figure 4:
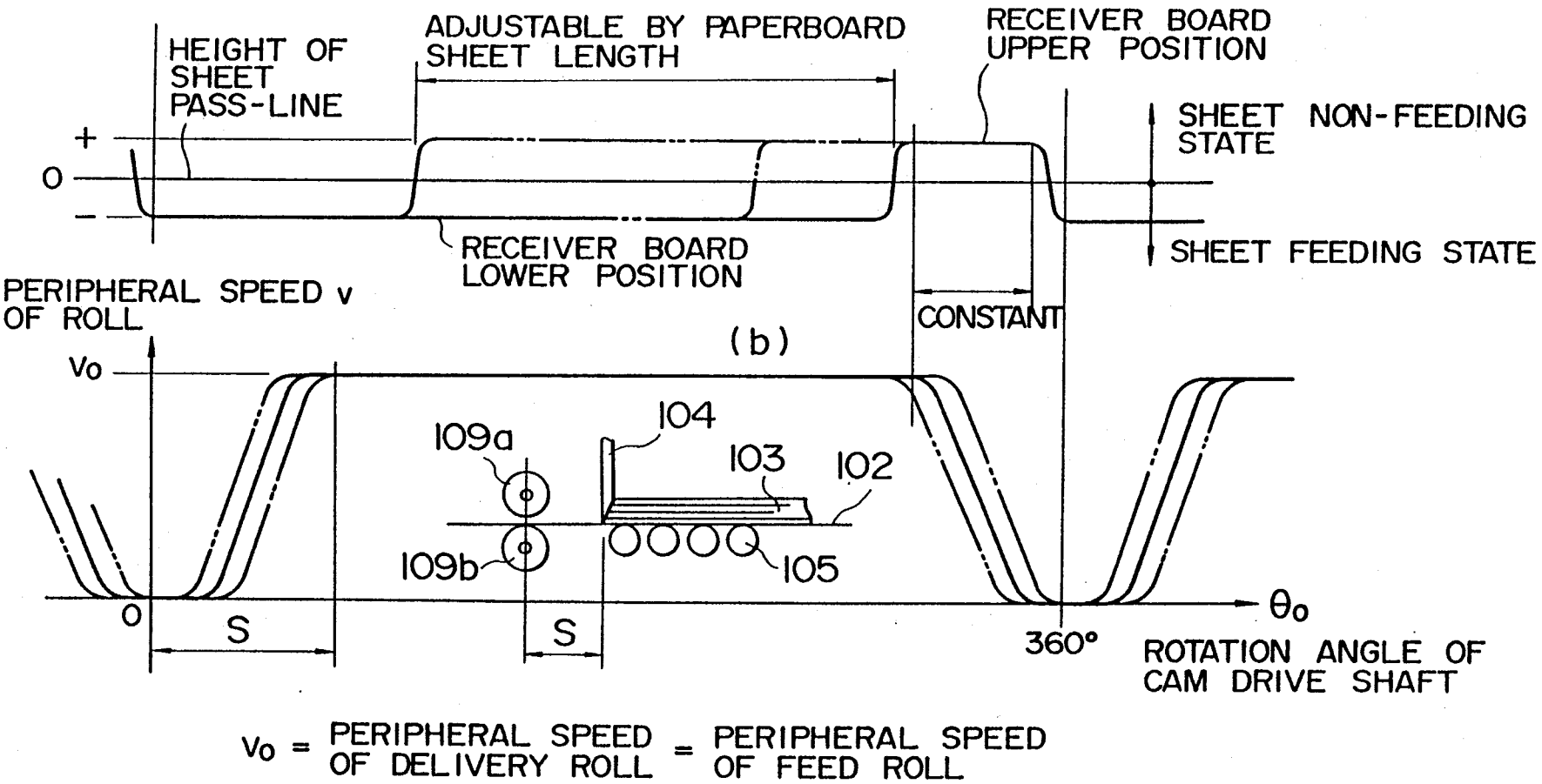
FIG. 4 shows explanatory diagrams for explaining the function (operation timing) of the lead edge feeder.
Figure 5A:
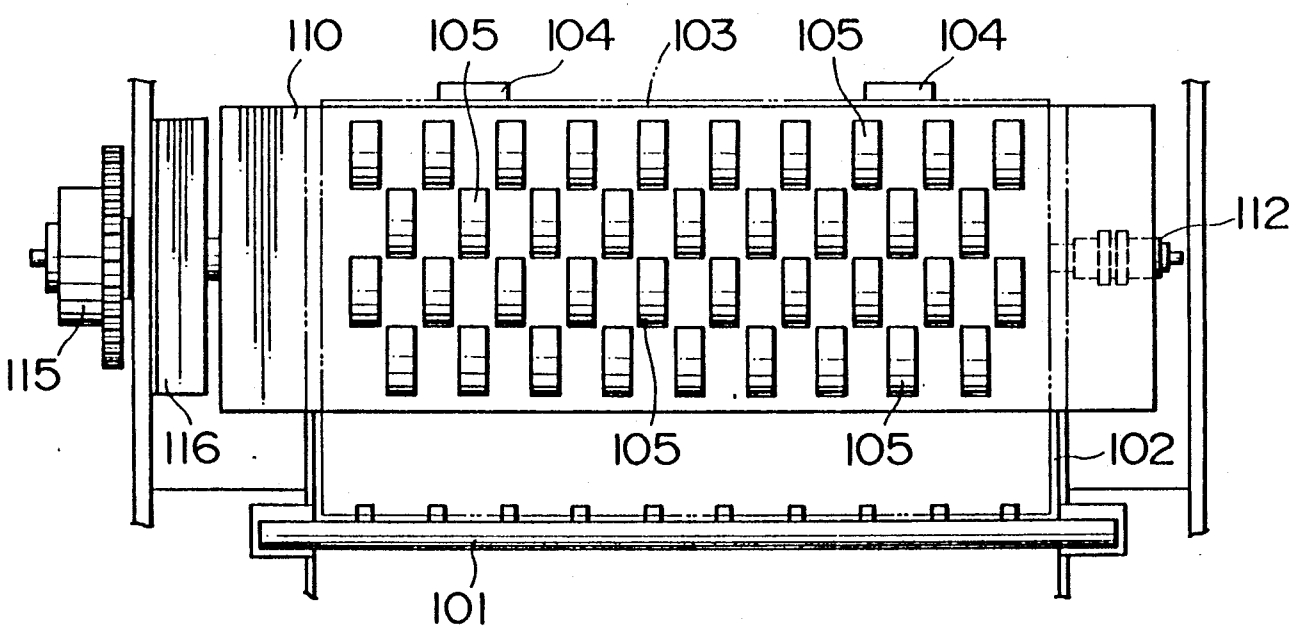
FIG. 5 (*a*) is a plan view showing a schematic construction of the present feeding apparatus, and FIG. 5 (*b*) is a front view thereof.
Figure 5B:
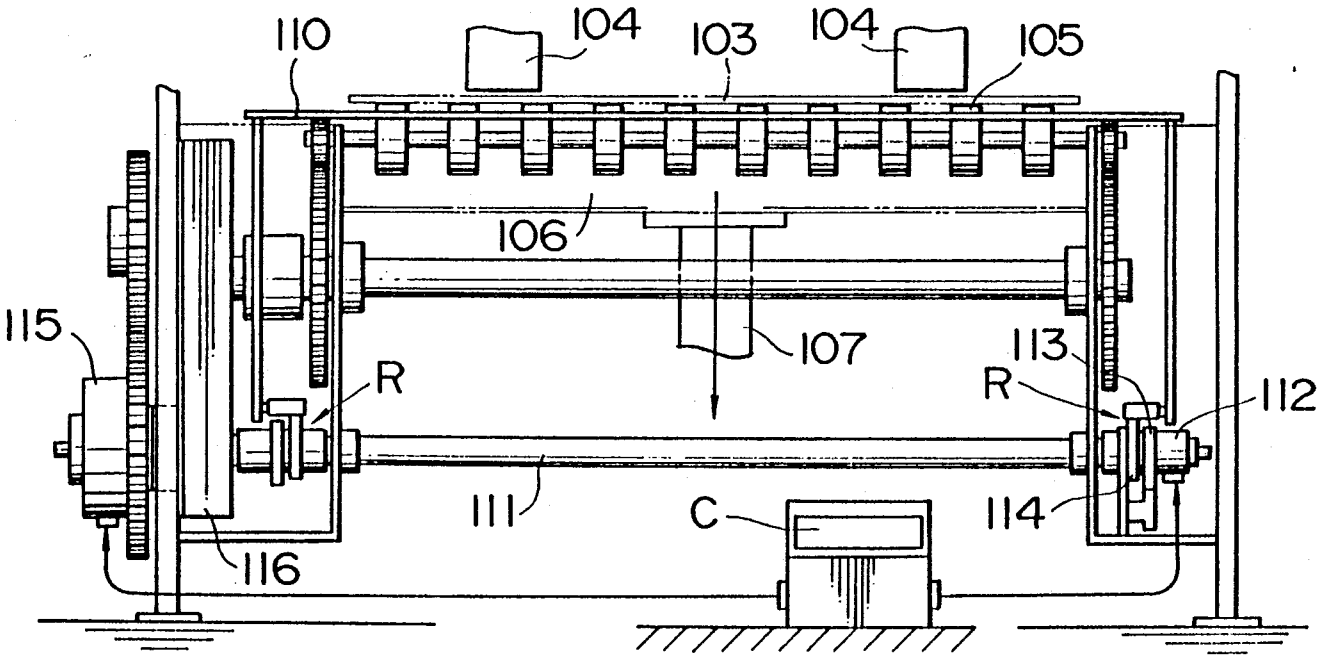

A second embodiment of the present invention will be described hereafter with reference to the drawings. FIG. 3 thru FIG. 5 are explanatory views of a schematic construction and a function of a paperboard feeding apparatus installed on a box making machine for corrugated board sheets. In those figures, a backstop 101 in a feeding section is constructed so that it moves forward and rearward on a feeding table 102 and it may be fixed at an optional position corresponding to the length of a charged corrugated board sheet 103 in feeding direction as shown in FIG. 3. The corrugated board sheet 103 charged in a pre-process (apparatus) not shown abuts against a front guide 104 and drops, and is piled up successively between the front guide 104 and the backstop 101. A plurality of delivery rolls 105 are provided in a state of projecting slightly above the feeding table 102 under the piled up lowest layer sheet 103*a*.

Further, the inside of a suction box 106 is communicated with a suction blower 108 through a duct 107. The suction box 106 is brought into an almost sealed state with an upper suction port (hole) covered by the lowest layer sheet 103*a*. The lowest layer sheet 103*a* is drawn downward by the action of the suction blower 108 so as to increase the frictional force Fo with the delivery rolls 105 in contact. On the other hand, a frictional force F caused by the weight (direct pressure) of the sheets piled up above a sheet 103*b* at the second step is generated on the lowest layer sheet 103*a*. The lowest layer sheet 103*a* is delivered through a gap formed at the lower end of the front guide 104 by the difference in frictional forces generated on the top surface and the under surface thereof (delivery force $f=Fo-F$ generated on the sheet), and delivered further to a printing section P in a following process by the rotation while being supported by feed rolls 109*a* and 109*b* provided downstream.

Reference numeral 110 denotes a receiver board, and a plurality of holes are formed at locations corresponding to a delivery roll 105 group disposed in a zigzag form on a plane of the receiver board 110 as shown in FIG. 5 (*a*). The receiver board 110 is supported through an elevating unit R (see FIG. 5(*b*) so that the relative height position with respect to the upper peripheral surfaces of the rolls 105 may be variable. Further, the elevating unit R is provided with a cam drive shaft 111 which rotates once per one cycle of feeding operation repeated successively. The cam drive shaft 111 is provided with an ascending cam 113 which may be set at an optional angle through an indexing unit 112 and a descending cam 114 which is fixed to the cam drive shaft 111 and rotates at the same timing, and is constructed so that the release timing (feeding stop operation timing) of the lowest layer sheet 103*a* with respect to the delivery rolls 105 may be set freely.

An indexing unit 115 which adjusts the rotation start timing of the delivery rolls 105 functions so as to set the feeding initial timing while correcting the timing fore and aft through a well-known speed change gear 116. Further, the indexing unit 112 which sets the ascent timing of above-mentioned receiver board 110 optionally and the indexing unit 115 which sets the rotation start timing of the delivery rolls 105 optionally may be operated manually, but may also be set automatically to a timing which concurs with conditions through feedback control by inputting data such as machine speed (theoretical feeding speed of the paperboard), weight of piled up paperboards (direct pressure), paperboard material(coefficient of friction) and size (width x length) of paperboard to a predetermined control unit C.

Next, a control method of a lead edge type paperboard feeding apparatus in the present embodiment will be described. FIG. 4 is an explanatory view for explaining the function (operation timing). FIG. 4 (*a*) shows an ascent and descent timing of the receiver board 110 and FIG. 4 (*b*) shows a peripheral speed v of the delivery rolls 105 which drives to rotate intermittently for a rotation angle (axis of abscissa) $\theta$ of the cam drive shaft 111 which rotates once per one cycle of feeding operation. When this is described briefly, the receiver board 110 is made is descend, and the lowest layer sheet 103*a* is delivered to have it come into contact with the peripheral surfaces of the rolls 105. Thereafter, the delivery rolls 105 are rotated with acceleration, and the tip of the corrugated board sheet 103 delivered in a state of synchronizing with peripheral speeds of downstream feed rolls 109*a* and 109*b* is made to be held inbetween the feed rolls 109*a* and 109*b*. Furthermore, the delivery rolls 105 are rotated at the same speed for a predetermined period of time. With this, a sheet delivery load acting on the feed roll 109 is reduced.

Next, contact between the delivery rolls 105 and the sheet 103*a* is released by ascending the receiver board 110 after delivery at a predetermined angle (length), and the delivery rolls 105 are stopped with speed reduction and kept waiting in that state. On the other hand, the receiver board 110 descends after the delivery rolls 105 are stopped to rotate, and is stopped in a state that the sheet 103*b* is brought into contact with the outer peripheral surfaces of the delivery rolls 105. Above-described operation is repeated successively thereafter, and piled up sheets are delivered from the lowest layer sheet one sheet at a time.

The operation is performed as described above as a basic function of a feeding apparatus, but the following function is added further to the feeding apparatus of the present embodiment. Namely, the feeding start timing can be selectively set in a freely movable manner fore and aft as shown with a dashed line in FIG. 4 (*b*) by means of the equipped indexing unit 115, and the receiver board ascent timing (paperboard feeding stop timing) can be selectively act freely as shown with a broken line in FIG. 4 (*a*) by means of the indexing unit 112. As a result, positional dislocation in the sheet travelling direction in a following printing process can be corrected accurately in the feeding section, thus making it possible to manufacture products of high quality.

Incidentally, since it is possible that variety of conditions related to fore and aft slippage of the sheet feed timing, i.e., data such as above-mentioned machine speed, weight of piled up paperboards, and paperboard quality are inputted, thus setting the operation of the indexing units 112 and 115, it is possible to always maintain an ideal feed timing after correction. Accordingly, it is possible to cope with frequent order changes automatically and promptly. Besides, a large variety of methods may be thinkable with respect to operation timing and the like of respective sections.

The Third Embodiment

Figure 6:
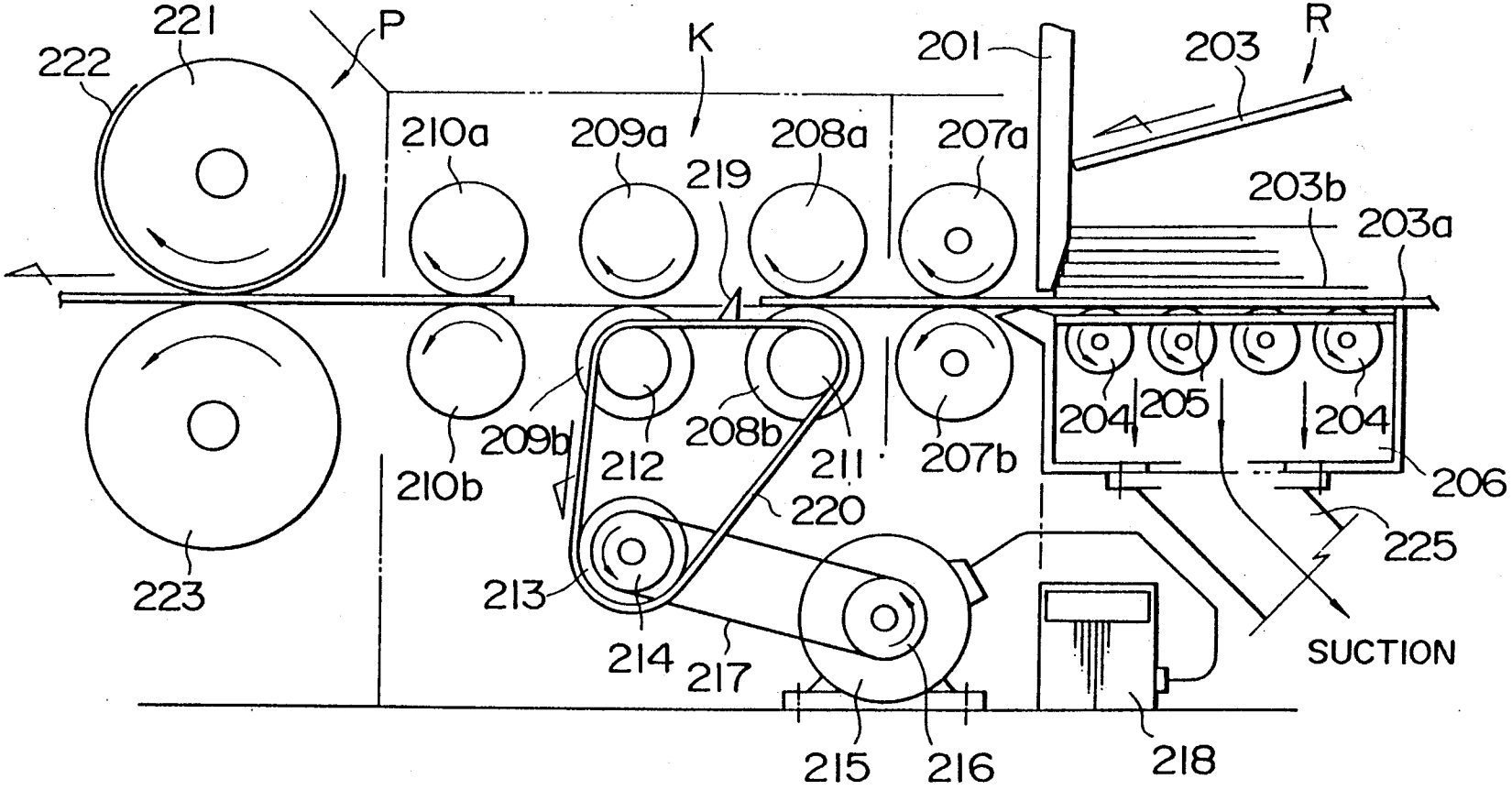
FIG. 6 is a side view showing a schematic construction of a feed timing remedy unit provided on a box making machine for corrugated board sheets showing a third embodiment of the present invention.
Figure 7:
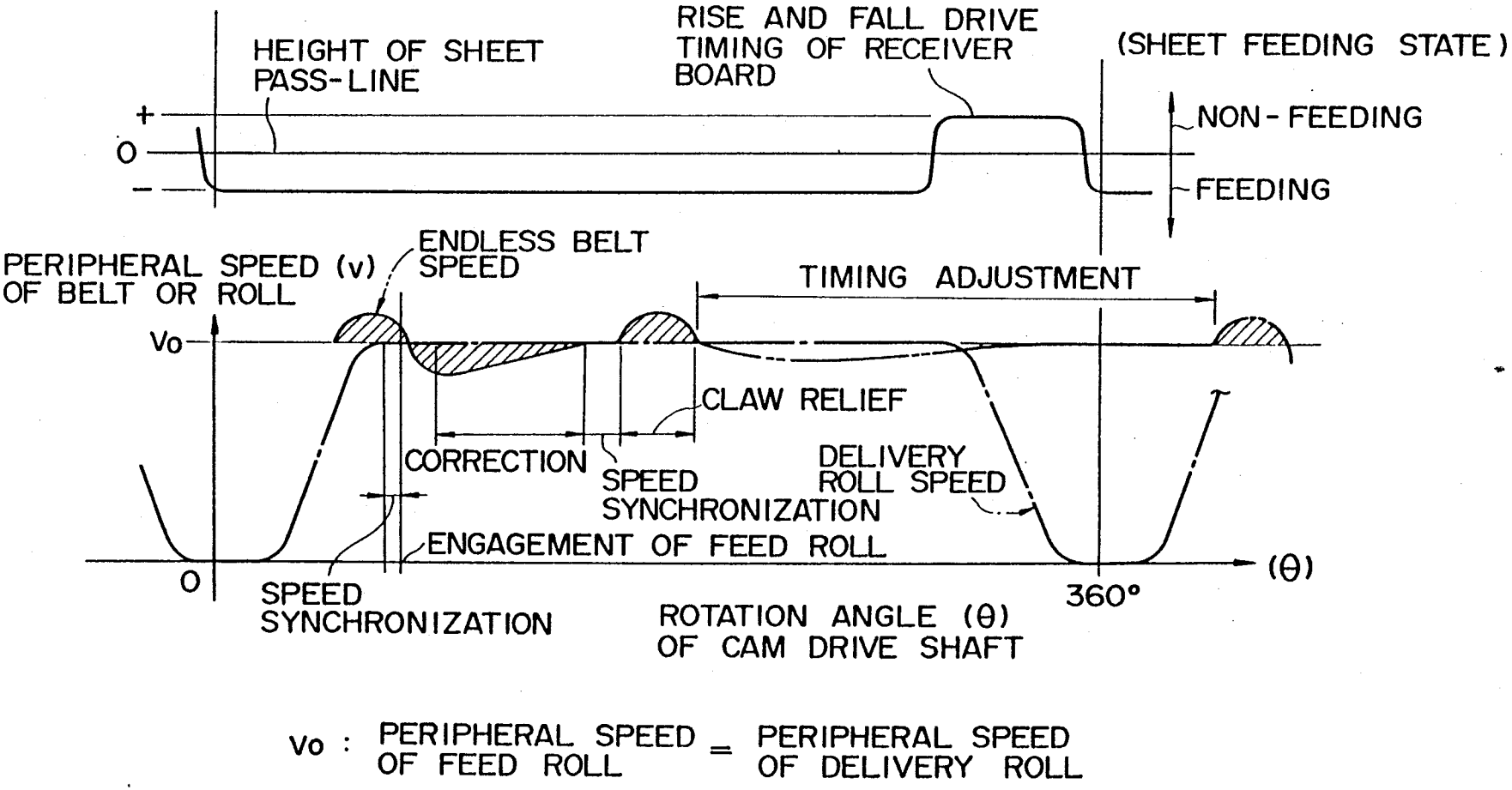
FIG. 7 is an explanatory diagram for explaining the function (operation timing) of the feeding section.
Figure 8:
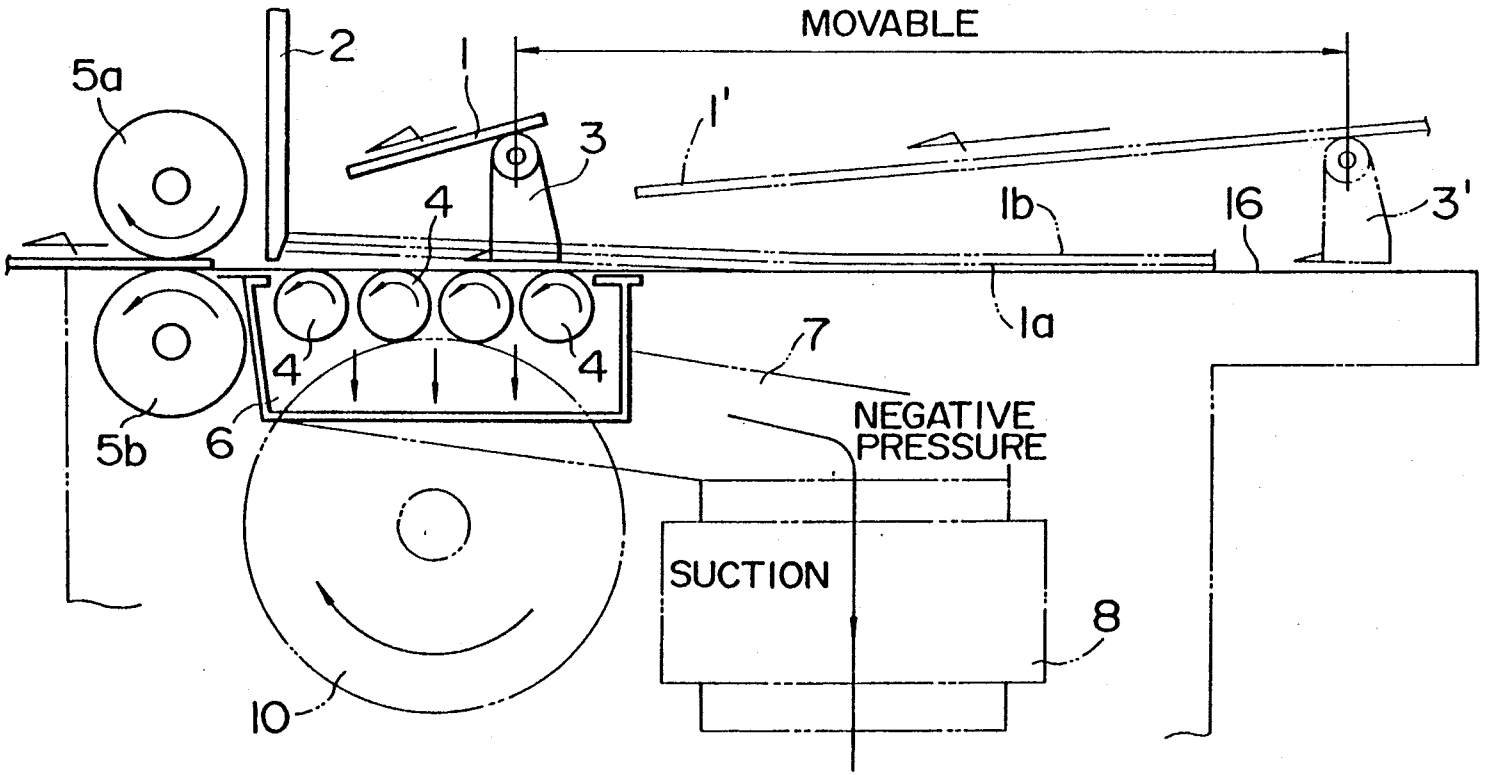
FIG. 8 is a side view for explaining a structure of a conventional paperboard feeding apparatus.
Figure 9:
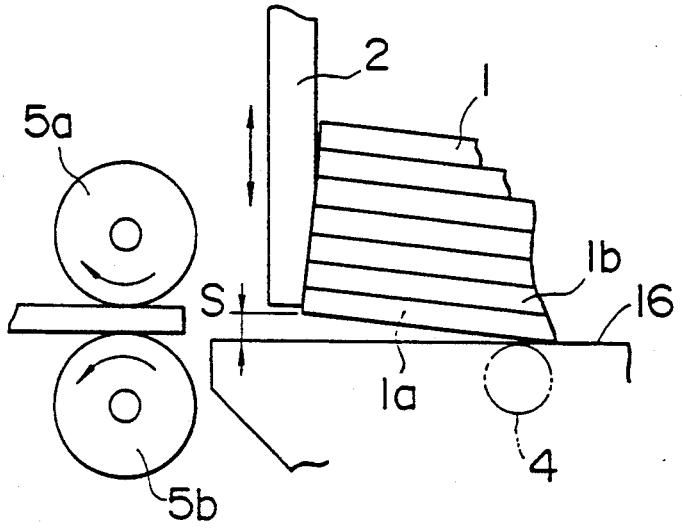
FIG. 9 and FIG. 10 are side views showing nonconformity phenomena of a conventional paperboard feeding apparatus.
Figure 10:
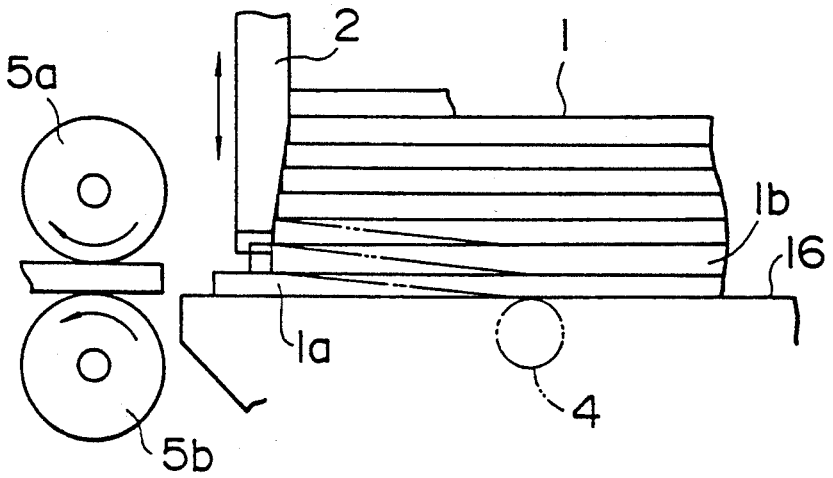
Figure 11:
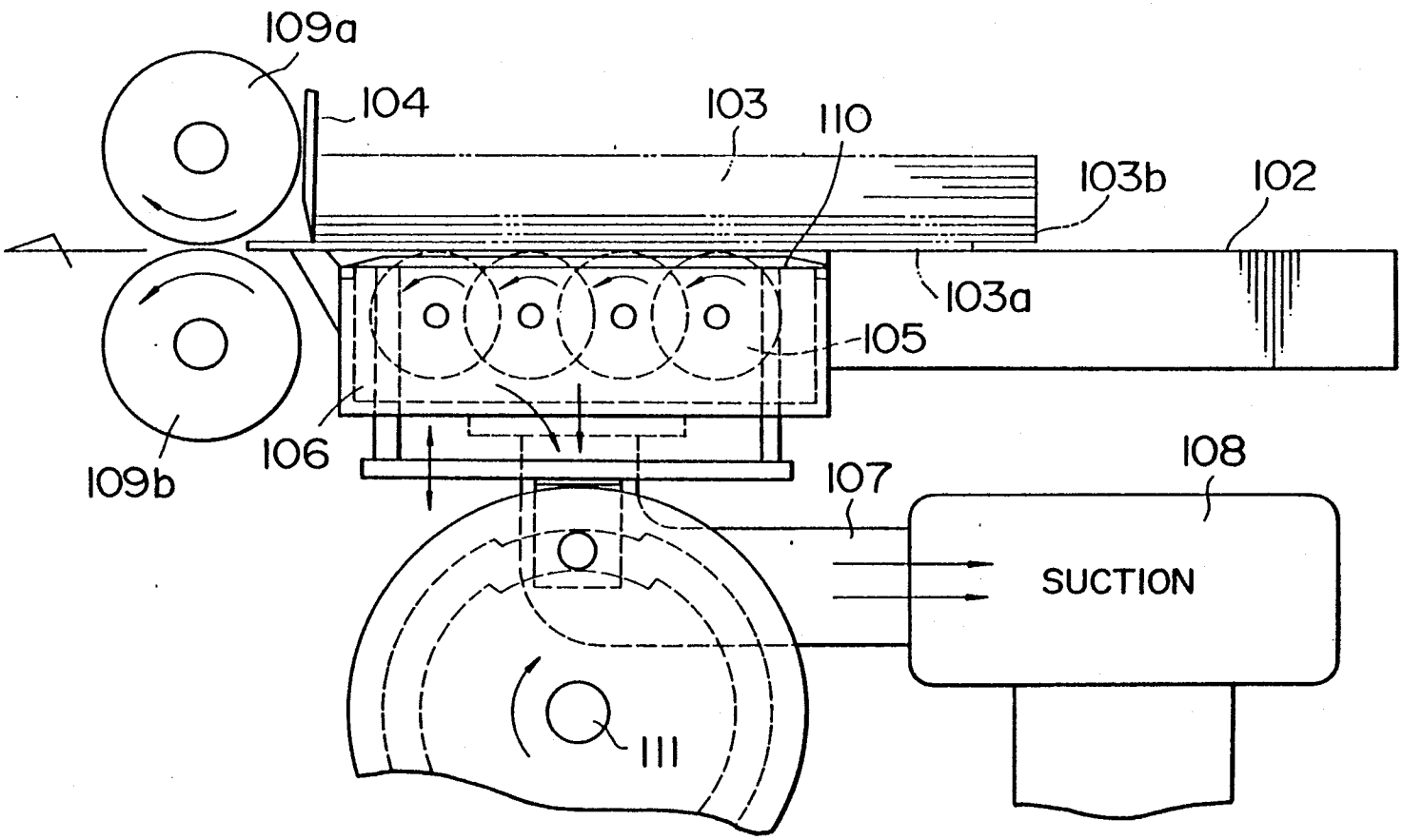
FIG. 11 is a side view of a conventional lead edge type feeding apparatus.
Figure 12:
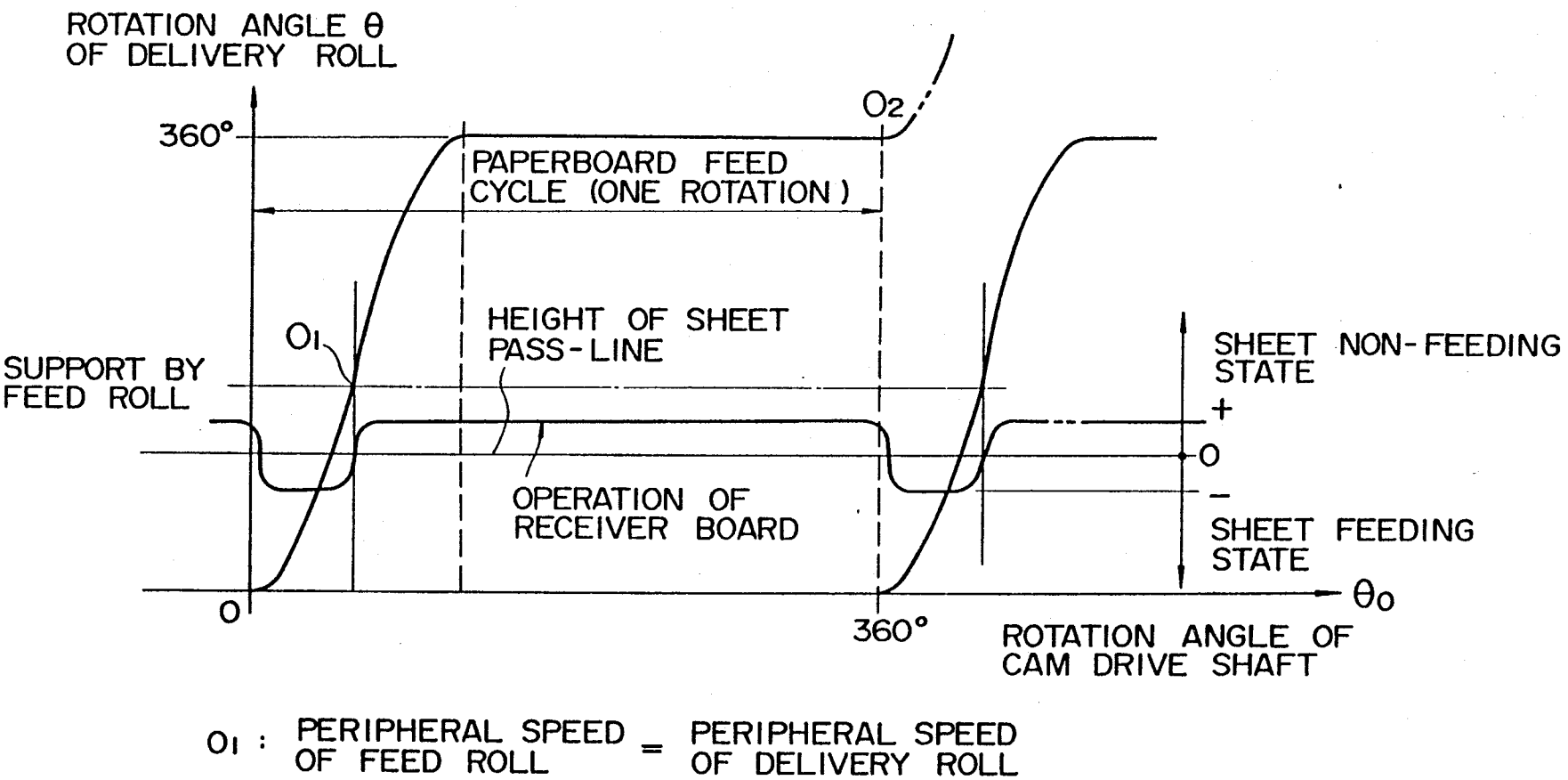
FIG. 12 is an explanatory diagram of the operation timing of the conventional lead edge feeder.
Figure 13:
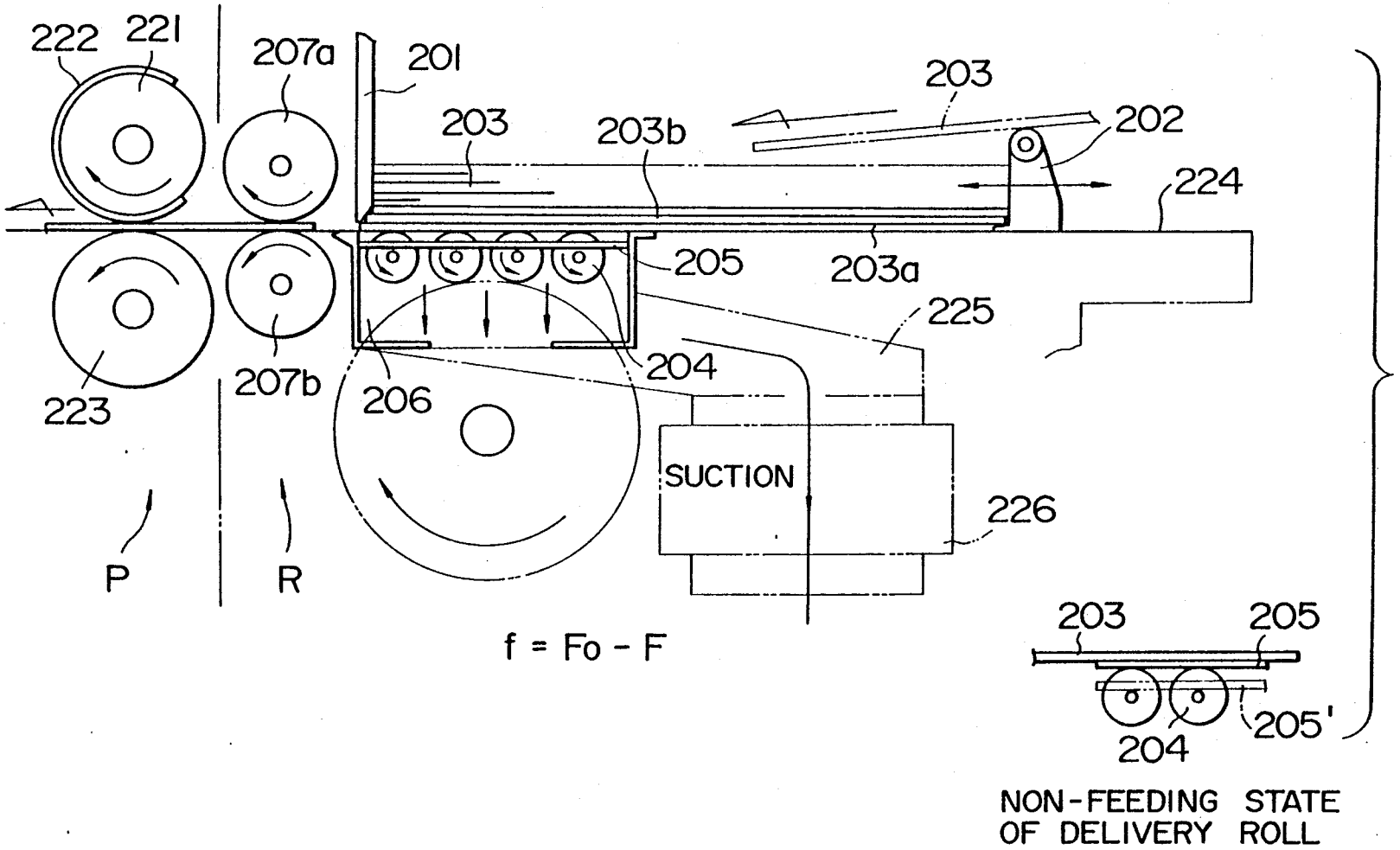
FIG. 13 is a side view of a conventional lead edge type feeding apparatus.
Figure 14:
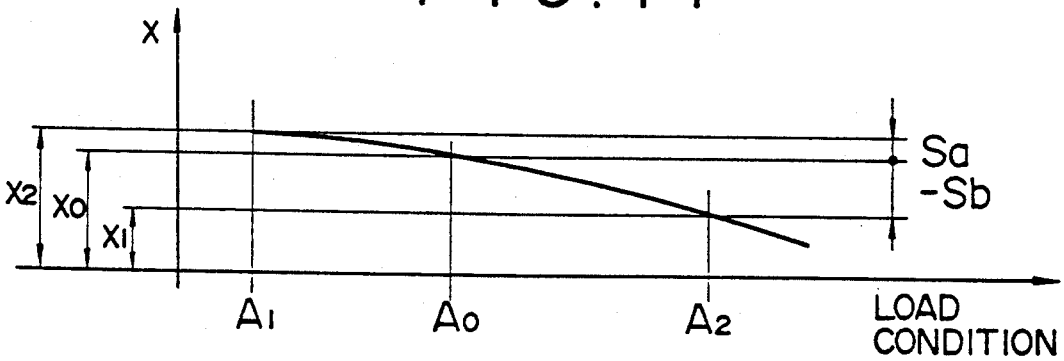
FIG. 14 is a are explanatory drawing for explaining feeding delay in a conventional feeding apparatus.
Figure 15A:
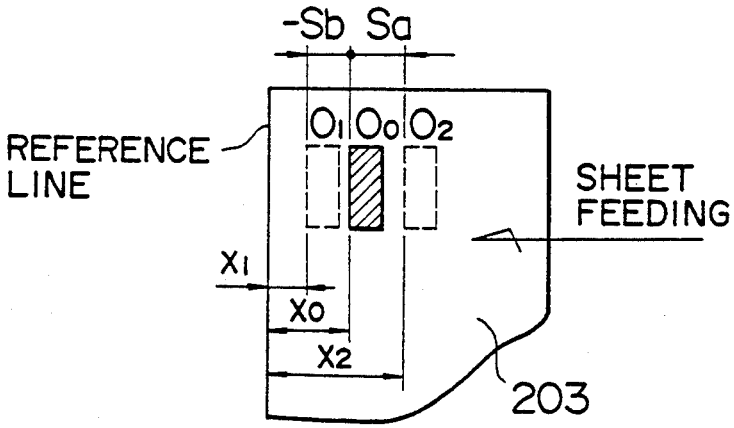
FIG. 15*a* shows changes in print starting position of a board sheet due to variations in paperfeed timing.
Figure 15B:
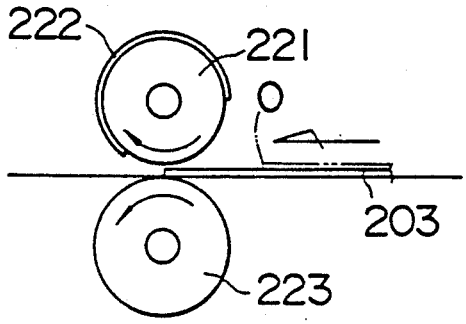
FIG. 15*b* shows the relationship between print starting position O of a board sheet and a printing plate on a plate cylinder.

A third embodiment of the present invention will be described hereafter with reference to the drawings. FIG. 6 and FIG. 7 show an embodiment of a feed timing remedy unit installed on a box making machine for corrugated board sheets, wherein FIG. 6 is a schematic block diagram thereof and FIG. 7 is an explanatory diagram of the function. In FIG. 6 and FIG. 7, a basic structure of a lead edge type paperboard feeding apparatus is provided with delivery rolls 204 which deliver paperboards 203 piled up in a hopper means between a front guide 201 and a backstop 202 one sheet at a time successively from the lowest layer and also with a receiver board 205 and the like which ascends and descends at a predetermined timing through a driving unit not shown and interrupts contact between the lowest layer sheet 203*a* and the outer peripheral surfaces of the delivery rolls 204. The function of a suction box 206 installed thereunder are similar to those that have been described with respect to above-described related art. Hence, detailed description thereof will be omitted herein.

Now, the present embodiment relates to a remedy unit which reforms front ends of paperboards delivered through the feeding apparatus so as to coincide with a predetermined timing, and delivers these paperboards to a following process, and the structure (construction, function) thereof will be described hereafter.

As shown in FIG. 6, at locations opposing to each other on the upper and lower sides of a sheet passline to downstream feed rolls 207*a* and 207*b* of a conventional feeding apparatus R, one set or a plurality of sets of feed rolls 208, 209 and 210 are disposed. Pulleys 211 and 212 are fitted rotatably to the shafts of the feed rolls 208*b* and 209*b*, respectively, and a pulley 213 is fitted at a location under the feed roll 209*b*. A synchronizing pulley 214 is attached fixedly to a part of a supported shaft of the pulley 213. The synchronizing pulley 214 and a synchronizing pulley 216 fixedly attached at a shaft end of a motor 215 are connected with each other by means of a synchronizing belt 217 wound around both pulleys. The motor 215 is constructed so that the rotational speed may be optionally set variably with a servomotor and the like by an instruction signal from a control unit 218 computed based on the speed of a feeding motor or the delivery rolls 204 and the like. Besides, it is preferably that the endless belt speed is operated in accordance with a preset speed diagram (FIG. 7).

Hereupon, an endless belt 220 is wound around above-mentioned pulleys 211, 212 and 213, and a claw 219 which is constructed so that the forward end of the paperboard abute against thereto is fitted to the endless belt 220. A plurality of belts are provided in parallel in the endless belt 220 in a machine width direction, but they may be formed in one piece of belt at the central position in point of function.

A feed timing remedy unit K of the present embodiment being constructed as described above, the corrugated board sheet 203 which has been delivered from the feeding apparatus R is delivered to the printing section P in the following process after the travel timing is corrected by the remedy unit K. Then printing is applied at an objective position by the rotation while being supported between a printing plate 222 wound around a plate cylinder 221 and an impression cylinder 223 similarly Next, the function will be described with reference to FIG. 7. FIG. 7 is an action timing diagram, in which an ascent and descent timing of the receiver board 205, a Peripheral speed V of the delivery rolls 204 which drive to rotate intermittently and a travelling speed V of the endless belt 220 with a claw installed on the timing remedy unit K are shown along an axis of ordinate against the rotation angle $\theta$ of the cam drive shaft which rotates once per one cycle of feeding action (axis of abscissa). The receiver board 205 is made to descend, thereby to have the lowest layer sheet 203*a* come in contact with the outer peripheral surfaces of above-mentioned delivery rolls 204. Thereafter, the delivery rolls 204 are rotated with acceleration, and the tip of the corrugated board sheet 203 which has been delivered in a state synchronized with the peripheral speed Vo of the downstream feed rolls 207*a* and 207*b* is made to be supported between above-mentioned feed rolls 207*a* and 207*b*. Thereafter, the delivery rolls 204 are rotated at the same speed for a predetermined period of time determined by the sheet length so as to encourage sheet feeding. As a result, the load acting on the feed roll 207 may be reduced.

Next, after rotating the delivery rolls 204 by a predetermined angle, that is, after the sheet is delivered by a predetermined length, the receiver board 205 is made to descend so as to release the delivery operation of the delivery rolls 204 and also to stop with speed reduction the delivery rolls 204. Thereafter, the above-mentioned action is repeated successively, and the piled up sheets 203 are delivered one sheet at a time from the lowest layer sheet.

Now, the sheet 203 delivered as described above is delivered into the downstream timing remedy unit K through the feed rolls 207*a* and 207*b*. The endless belt 220 which has been travelling synchronously with the peripheral speed of the feed roll 207 travels at a high speed immediately before the tip of above-mentioned delivered sheet 203 reaches there so as to have a claw 219 portion fixedly attached to proceed to a position where it travels in parallel along a sheet pass-line as shown in FIG. 6. Thereafter, the belt 220 is reduced in speed, and the sheet 203 is made to abut against the claw 219 portion when the sheet 203 arrives there, thus correcting relative timing with respect to a following process. Then, after the belt 220 is made to travel synchronously with the peripheral speed Vo of the feed rolls 207*a* and 207*b*, the belt 220 is rotated at a high speed again for a predetermined period of time, thereby to have the claw 219 engaged with the sheet tip evade downward. The sheet 203 is supported between the feed rolls 207, 208,209 and 210 that continue to rotate to drive at a predetermined speed, and is delivered to the printing section in a following process. Besides, as to the endless belt 220 which continues to travel, the travelling speed is controlled, and a relative position with respect to a cam drive shaft rotation angle is set so as to coincide with the next action timing. Thereafter, above-mentioned operation is repeated successively, and thus, the sheet 203 is delivered accurately at a predetermined timing corresponding to a downstream process.

The control of the travelling speed of the endless belt 220 is performed by an instruction signal from a control unit 218 through a driving motor 215, and the extent and the timing of increase/decrease in speed may be combined in various manners depending on conditions such as installation positions of feed rolls. Further, variety of types are also thinkable in connection with the structure as regards to a driving force transfer means, a winding method and the like of above-mentioned endless belt. These types are not limited to above-mentioned embodiments, but may be modified in various manners within a scope which does not depart from the gist of the present invention. Further, the driving mechanism of a feed timing remedy unit has been described with the synchronizing belt 217 and the endless belt 220 in the present embodiment, but it is only required to drive at a timing, and it is thinkable easily to replace it with a chain.

I claim:

1. A sheet feeding apparatus comprising:

a hoper means for receiving and piling up a plurality of sheets, said hopper means including a front guide and a back stop;

delivery means for delivering a single sheet from said hopper along a delivery path, said delivery means including delivery rollers rotating against said single sheet and transporting said single sheet past said front guide;

feed means for receiving said single sheet from said delivery means and transposing said single sheet along said delivery path, said feed means including a plurality of pairs of feed rollers positioned along said delivery path and downstream of said delivery means;

timing correction means for determining a portions of a front edge of said single sheet as said single sheet is transported along said delivery path, said timing correction means including pulleys rotatably mounted on two of said feed rolls, said pulleys being independently rotatable from said feed rolls, an endless belt mounted on said pulleys and moveable with said pulleys, and a claw mounted on said endless belt and moveable with said endless belt; and control means for controlling a movement of said claw on said endless belt, said control means moving said endless belt at a speed substantially in synchronization with said feed rolls, said control means positioning sad claw downstream and in front of said single sheet as said single sheet passes adjacent to said endless belt, said control means increasing said speed of said endless belt just before said front edge of said single sheet reaches said endless belt in order to have said claw advance downstream for said single sheet, said control means reducing said speed of said endless belt when said single sheet is adjacent said endless belt, said reducing of said speed causing said claw to contact said single sheet, said control means moving said endless belt as substantially a same speed as said single sheet after contact between said single sheet and said claw, said control means increasing said speed of said endless belt prior to said front edge of said single sheet passing downstream so as to separate said claw from said single sheet.

2. An apparatus for correcting a timing delay in a sheet feeder, the apparatus comprising:

delivery means for delivering a sheet along a delivery path with an unknown and unacceptable time delay;

feed means for receiving said sheet from said delivery means and transporting said sheet along said delivery path, said feed means including a plurality of pairs of feed rolls positioned along said delivery path and downstream of said delivery means;

timing correction means for determining a position of a front edge of said single sheet as said single sheet is transported along said delivery path, said timing correction means including pulleys rotatably mounted on two of said feed rolls, said pulleys being independently rotatable from said feed rolls, san endless belt mounted on said pulleys and moveable with said pulleys, a claw mounted on said endless belt and moveable with said endless belt; and control means for substantially synchronizing a speed and position of said endless belt with a speed and position of said single sheet and said feed rolls for a portion of time when said single sheet is adjacent said endless belt, said control means increasing said speed of said endless belt before said sheet reaches said endless belt to position said claw downstream and in front of said sheet, said control means decreasing said speed of said endless belt after said sheet is adjacent said endless belt, said decreasing of said speed causing said claw to contact said sheet, said control means substantially synchronizing said speed of said endless belt with said speed of said sheet when said sheet is in contact with said claw, said control means increasing said speed of said endless belt after said substantial synchronization and prior to a front edge of said sheet passing downstream of said endless belt, stow have said claw separate from said sheet.

3. An apparatus in accordance with claim 2, further comprising:

downstream process mean for receiving said single sheet from said feed means, said downstream process means being dependent on a timing of said receiving sheet, said control means substantially synchronizing said downstream process means with said speed of said sheet and said position of said sheet along said delivery path.

4. A method for correcting a time delay insheet feeding, the method comprising the steps of:

initiating delivery means to deliver said sheet to feed rolls, said sheet arriving at said feed rolls after an unknown and unacceptable timing delay;

providing pulleys rotatably mounted on two of said feed rolls, said pulleys being independently rotatable from said feed rolls;

providing an endless belt mounted on said pulleys and movable with said pulleys;

providing a claw mounted on said endless belt and moveable with said endless belt;

rotating said feed rolls to transport said sheet across said endless belt;

rotating said endless belt;

increasing a speed of said endless belt to position said claw downstream of said sheet before said sheet arrives at said endless belt;

decreasing said speed of said endless belt to cause said claw to contact said sheet as said sheet moves across said endless belt; and substantially synchronizing said rotating of said endless belt with said moving of said sheet in order to determine and correct the timing delay.

5. A method in accordance with claim 4, further comprising:

increasing said speed of said endless belt after said substantial synchronization, in order to separate said claw from said sheet.

6. A method in accordance with claim 4, further comprising:

providing a downstream process receiving said sheet from said feed rolls, said downstream process being dependent on a timing of said receiving sheet; and substantially synchronizing said downstream process with said endless belt during said substantially synchronizing of said endless belt with said sheet.

7. A method in accordance with claim 4, wherein:

said increasing of said endless belt tis to speed that is higher than a speed of said sheet; and said synchronizing of said endless belt also synchronizes said feed rolls which control said transporting of said sheets o that said endless belt, said sheet and said feed rolls all operate at a substantially similar speed during said synchronizing.

8. A method in accordance with claim 7 wherein: p1 said substantially similar speed of said endless belt, said sheet and said feed rolls are substantially similar to a speed of a terminal speed of said sheet delivered to said feed rolls.

* * * * *